US009145853B2

(12) United States Patent
Browne et al.

(10) Patent No.: US 9,145,853 B2
(45) Date of Patent: Sep. 29, 2015

(54) EXHAUST GAS RECIRCULATION COOLER AND SYSTEM

(71) Applicant: GM GLOBAL TECHNOLOGY OPERATIONS LLC, Detroit, MI (US)

(72) Inventors: Alan L. Browne, Grosse Pointe, MI (US); Nancy L. Johnson, Northville, MI (US); Patrick G. Szymkowicz, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 209 days.

(21) Appl. No.: 14/023,935

(22) Filed: Sep. 11, 2013

(65) Prior Publication Data

US 2015/0068502 A1 Mar. 12, 2015

(51) Int. Cl.
*F02M 25/07* (2006.01)

(52) U.S. Cl.
CPC ..... *F02M 25/0737* (2013.01); *F01P 2060/16* (2013.01)

(58) Field of Classification Search
CPC ..... F02M 25/0701; F02M 25/0737; F02M 25/0734; F02D 7/00; F28F 13/00; F28F 13/08; F28F 1/006; F28F 1/025
USPC ..... 123/568.12
See application file for complete search history.

(56) References Cited

U.S. PATENT DOCUMENTS

| | | | | |
|---|---|---|---|---|
| 3,339,631 | A * | 9/1967 | McGurty et al. | 165/109.1 |
| 2007/0056721 | A1* | 3/2007 | Usui et al. | 165/183 |
| 2009/0101319 | A1* | 4/2009 | Ashe | 165/133 |
| 2011/0226222 | A1* | 9/2011 | Raduenz et al. | 123/568.12 |

* cited by examiner

*Primary Examiner* — Hung Q Nguyen
(74) *Attorney, Agent, or Firm* — Quinn Law Group, PLLC

(57) ABSTRACT

An exhaust gas recirculation (EGR) cooler for cooling exhaust gas via a coolant includes at least one channel having an inlet and an outlet, and a casing defining a cooling chamber for carrying the coolant around the at least one channel. The exhaust gas is flowable through the at least one channel from the inlet to the outlet. At least a portion of the at least one channel is variable between a fully compressed position and an uncompressed position. The casing includes a coolant inlet and a coolant outlet through which the coolant enters and exits the cooling chamber. The casing also includes an exhaust gas inlet from which the exhaust gas enters the at least one channel, and an exhaust gas outlet into which the exhaust gas exits the at least one channel.

20 Claims, 2 Drawing Sheets

EXHAUST GAS RECIRCULATION COOLER AND SYSTEM

TECHNICAL FIELD

The present invention relates to an exhaust gas recirculation (EGR) cooler and system for cooling exhaust gas from an internal combustion engine, and a method thereof.

BACKGROUND

Many vehicles employ an exhaust gas recirculation (EGR) system to reduce nitrogen oxides (NOx) in an internal combustion engine's exhaust gas and to improve fuel economy. In EGR systems, a portion of the exhaust gas is recirculated to the intake manifold of the engine where the exhaust gas displaces the amount of combustible matter or oxygen normally inducted into the engine, thereby reducing the rate of NOx formation. In addition, many EGR systems implement an EGR cooler in which a coolant is used to cool the exhaust gas. This results in lower combustion chamber temperatures, which in turn increases the effectiveness of the EGR system in reducing the NOx formation.

SUMMARY

An exhaust gas recirculation (EGR) cooler for cooling exhaust gas from an internal combustion engine with a coolant is provided. The EGR cooler includes at least one channel through which the exhaust gas is flowable. The at least one channel has an inlet and an outlet. At least a portion of the at least one channel is variable between a fully compressed position and an uncompressed position.

The EGR cooler also includes a casing defining a cooling chamber for carrying the coolant around the at least one channel. The cooling chamber is configured to enable heat transfer between the exhaust gas and the coolant. The casing includes a coolant inlet through which the coolant enters the cooling chamber, and a coolant outlet through which the coolant exits the cooling chamber. The casing also includes an exhaust gas inlet from which the exhaust gas enters the at least one channel, and an exhaust gas outlet into which the exhaust exits from the at least one channel.

An exhaust gas recirculation (EGR) system for cooling gas from an internal combustion engine with a coolant is also provided. The EGR system includes the EGR cooler described above. The EGR system also includes an exhaust gas circuit configured to circulate the exhaust gas from the internal combustion engine through the at least one channel of the EGR cooler and back to the internal combustion engine. The EGR system further includes a coolant circuit configured to circulate the coolant through the cooling chamber of the EGR cooler such that heat is transferrable between the exhaust gas and the coolant.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

Figure 1:
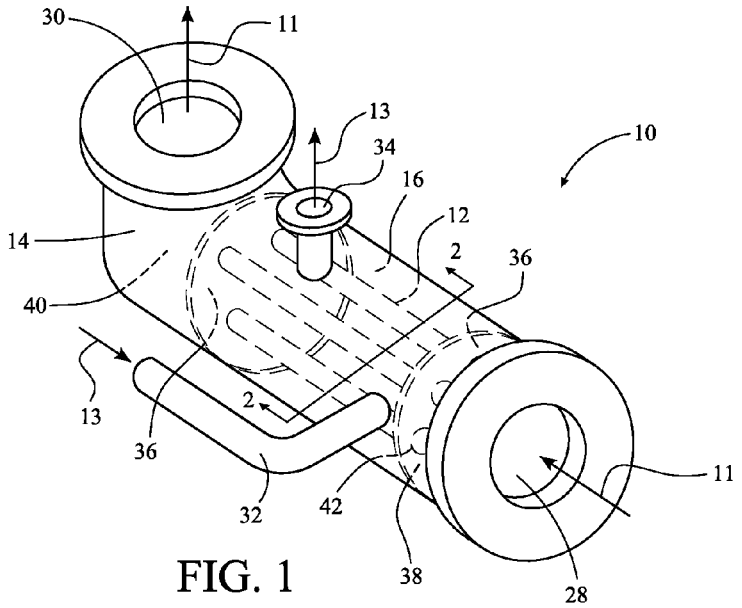
FIG. 1 is a schematic, perspective view of an exhaust gas recirculation (EGR) cooler.

Referring to the drawings, wherein like reference numbers correspond to like or similar components wherever possible throughout the several figures, an exhaust gas recirculation (EGR) cooler 10 is shown in FIG. 1. The EGR cooler 10 generally is a heat exchanger used to cool exhaust gas 11 from an internal combustion engine 102 via a coolant 13, as seen in the EGR system 100 in FIG. 6. The EGR cooler 10 generally includes channels 12 through which the exhaust gas 11 flows, and a casing 14 that defines a cooling chamber 16 around the channels 12, as seen in FIG. 2.

The cooling chamber 16 is configured to enable the heat transfer between the exhaust gas 11 and the coolant 13. The casing 14 has an exhaust gas inlet 28, an exhaust gas outlet 30, a coolant inlet 32, and a coolant outlet 34. The exhaust gas 11 flows into the channels 12 through the exhaust gas inlet 28, and exits the channels 12 into the exhaust gas outlet 30. The coolant 13 enters and exits the cooling chamber 16 through the coolant inlet 32 and the coolant outlet 34, respectively.

The EGR cooler 10 may also include end plates 36 at the exhaust gas inlet 28 and the exhaust gas outlet 30 to form an inlet chamber 38 and an outlet chamber 40, respectively, that serve to prevent leaking of the exhaust gas 11 into the coolant 13, and vice versa. The end plates 36 each may have corresponding openings 42 connected by the channels 12 such that the exhaust gas 11 may flow from the inlet chamber 38 to the outlet chamber 40 through the channels 12.

Figure 2:
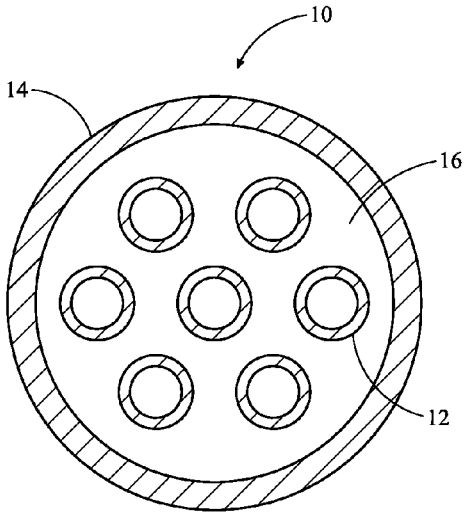
FIG. 2 is a schematic, cross-sectional view of the EGR cooler of FIG. 1.

Referring now to FIG. 2, each of the channels 12 generally may be any passageway capable of allowing the exhaust gas 11 to flow through it. For example, in one embodiment, the channels 12 may be tubes with a substantially circular cross-sectional area, as depicted in FIG. 2. In another embodiment, the channels 12 may be hollow plates. While FIG. 2 shows the EGR cooler 10 as having seven channels 12, it should be appreciated that it may have any number of channels 12. In addition, while FIG. 2 shows the EGR cooler 10 as having a substantially circular cross-section, it should be appreciated that it may have a cross-section of any regular or irregular geometric shape.

Figure 3:
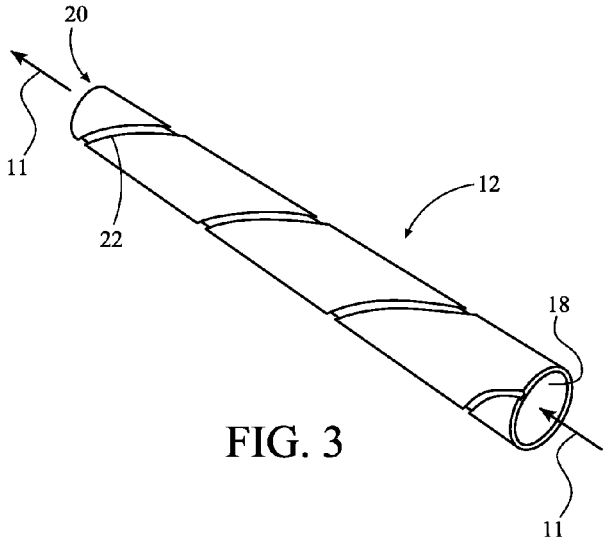
FIG. 3 is a schematic, perspective view of a channel of the EGR cooler of FIG. 1.

Referring now to FIG. 3, each channel 12 has an inlet 18 and an outlet 20 through which the exhaust gas 11 enters and exits the channel 12. The channel 12 may be tapered from the inlet 18 to the outlet 20, i.e., the cross-sectional area of the channel 12 decreases from the inlet 18 to the outlet 20. The tapering of the channel 12 may or may not be linear.

Generally, as exhaust gas travels along a length of a passageway, the temperature and the velocity of the exhaust gas decrease. The reduced velocity, in turn, increases the amount of ash deposits, or fouling, that occur within the passageway. The tapering of the channel 12 from the inlet 18 to the outlet 20 helps maintain a more uniform velocity across the length of the channel 12 to reduce the amount of fouling. The amount of tapering may be dependent upon such factors as the temperature of the exhaust gas 11, the material of the channel 12, the length of the channel 12, the coolant 13 used to cool the exhaust gas 11, the flow rate of the coolant 13, and the like.

The channel 12 is also variable between a fully compressed position and an uncompressed position. The cross-sectional area of the channel 12 at or near the outlet 20 is smallest in the fully compressed position, and is greatest in the uncompressed position. The channel 12 may be tapered in both the fully compressed position and the uncompressed position, where the channel 12 has a greater taper in the compressed position than in the uncompressed position. In the early stages of operation, the heat transfer and the reduction in velocity of the exhaust gas 11 along the length of the channel 12 is greatest. As the temperature within the channel 12 increases, the velocity drop is not as severe. As such, a greater tapering of the channel 12, i.e., a greater differential in the cross-sectional area of the channel 12 between the inlet 18 and the outlet 20, is desired in the early stages. The variable nature of the channel 12 between the fully compressed position and the uncompressed position allows the channel 12 to account for the stage of operation and the temperature within the channel 12 to maintain a substantially uniform velocity, as explained above. The channel 12 may be actively cycled between the fully compressed position and the uncompressed position to break apart and dislodge the ash deposits (or other particles), thereby reducing the fouling.

To enable the variable nature, the channel 12 may define at least one slot 22 around at least a portion of the channel 12. The slot 22 may be partially or completely through the wall of the channel 12. In embodiments in which the slot 22 is completely through, the channel 12 may include an additional barrier (not shown) around the channel 12 in order to prevent the exhaust gas 11 from entering the cooling chamber 16 and the coolant 13 from entering the channel 12. The barrier may be expandable and compressible as well. The slot 22 enables the channel 12 to partially collapse when a compression is applied to it such that the cross-sectional area of the channel 12 decreases around the location that the compression is applied. When the compression is removed, the channel 12 may expand back to the uncompressed position.

Figure 4:
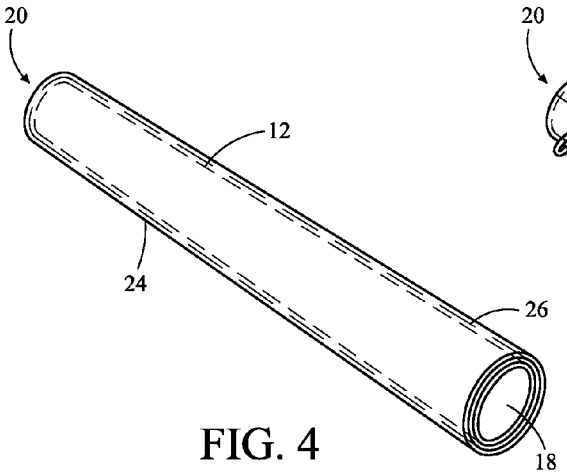
FIGS. 4 and 5 are schematic, perspective views of the channel of FIG. 3 with an actuator according to different embodiments.
Figure 5:
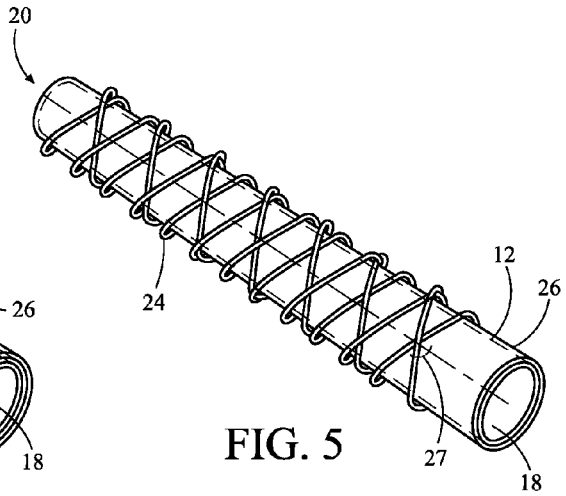

Referring now to FIGS. 4 and 5, the EGR cooler 10 may include an actuator 24 configured to vary the channel 12 between the fully compressed position and the uncompressed position. The actuator 24 may be, but is not limited to, an outer sleeve around the channel 12, as seen in FIG. 4, or at least one wire braided around the channel 12 at a given braid angle 27, or the angle between the longitudinal axis of the channel 12 and the at least one wire, as seen in FIG. 5. The braid angle 27 may determine whether the actuator 24 compresses or expands the channel 12. In one embodiment, when the braid angle 27 is less than 55 degrees, the actuator 24 is configured to expand the channel 12. In another embodiment, when the wrap angle 27 is greater than 55 degrees, the actuator 24 is configured to compress the channel 12, as is also the case for embodiments in which the actuator 24 is an outer sleeve. It should be appreciated that the wire actuator 24 may be, but is not limited to, a wire, a strip, a cable, a knit, and the like, and may be in any geometrical form that is sufficiently linear such that it is suitable for wrapping and/or braiding.

The actuator 24 may be made of a shape memory alloy. As used herein, the terminology "shape memory alloy" refers to alloys which exhibit a shape memory effect. Specifically, the actuator 24 may undergo a solid state phase change via molecular rearrangement to shift between a martensite phase and an austenite phase. In general, the martensite phase refers to the comparatively lower-temperature phase and is often more deformable than the comparatively higher-temperature austenite phase. The temperature at which the actuator 24 begins to change from the austenite phase to the martensite phase is known as the martensite start temperature, $M_s$. The temperature at which the actuator 24 completes the change from the austenite phase to the martensite phase is known as the martensite finish temperature, $M_f$. Similarly, as the actuator 24 is heated, the temperature at which the actuator 24 begins to change from the martensite phase to the austenite phase is known as the austenite start temperature, $A_s$. The temperature at which the actuator 24 completes the change from the martensite phase to the austenite phase is known as the austenite finish temperature, $A_f$.

The actuator 24 may be characterized by a cold state, i.e., when a temperature of the actuator 24 is below the martensite finish temperature $M_f$ of the shape memory alloy. Likewise, the actuator 24 may also be characterized by a hot state, i.e., when the temperature of the actuator 24 is above the austenite finish temperature $A_f$ of the shape memory alloy. In embodiments in which the actuator 24 is an outer sleeve or at least one wire braided around the channel 12 at a braid angle 27 that is greater than 55 degrees, the actuator 24 maintains the channel 12 in the uncompressed position when in the cold state, and compresses the channel 12 toward the fully compressed position when heated to the hot state. Conversely, in embodiments in which the actuator 24 is at least one wire braided around the channel 12 at a braid angle 27 that is less than 55 degrees, the actuator 24 maintains the channel 12 in the compressed position when in the cold state, and causes the channel 12 to expand to the uncompressed state when heated to the hot state. In any of these embodiments, when the actuator 24 cools back down to the cold state, the channel 12 reverts back to its original geometry, i.e., either the fully compressed position or the uncompressed position depending upon the embodiment, as described above. This is as a result of the energy elastically stored in the channel 12 while it is deformed in the hot state.

The actuator 24 may be heated passively and/or actively. Passive heating occurs from the natural heat transfer from the exhaust gas 11 passing through the channel 12. Depending upon the temperature of the exhaust gas 11 and the material and/or composition of the actuator 24, the EGR cooler 10 may have an insulation layer 26 between the actuator 24 and the channel 12. This may serve to prevent overheating of the actuator 24, as well as premature changing of its shape, as described above. The insulation layer 26 may be made of a porous material. Active heating occurs by passing a current through the actuator 24. To accomplish this, the EGR cooler 10 may further include a current source 108, as seen in the EGR system 100 of FIG. 6. In such embodiments, the actuator 24 may be made of a material, e.g., the shape memory alloy described above, that has an austenite finish temperature Af that is higher than the temperature to which the actuator 24 is exposed in passive heating. This ensures that the actuator 24 is not actuated via passive heating when it is not desired. Active heating may be utilized to cycle the channel 12 between the fully compressed position and the uncompressed position to dislodge any particle buildup, as described above.

Figure 6:
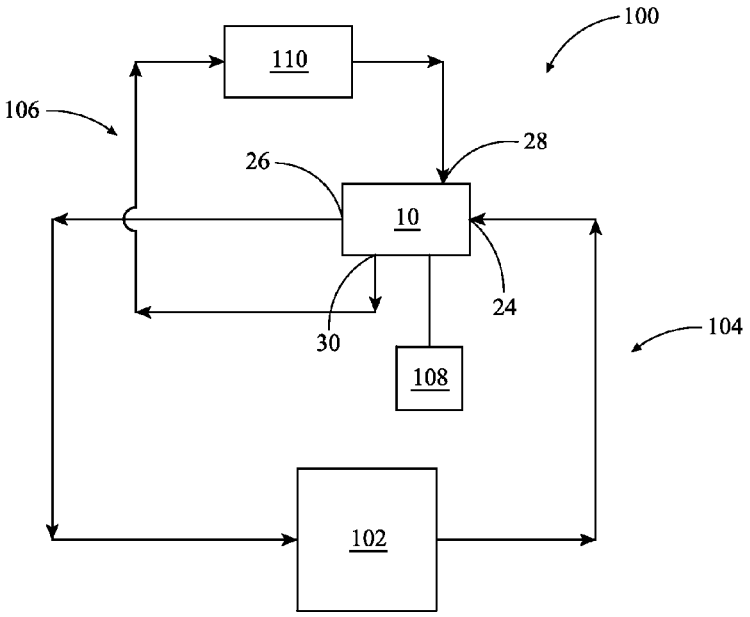
FIG. 6 is a schematic, flow and block diagram of an EGR system incorporating the EGR cooler of FIG. 1.

Referring now to FIG. 6, an EGR system 100 for cooling the exhaust gas 11 with the coolant 13 is shown. The system includes the EGR cooler 10, an exhaust gas circuit 104, and a coolant circuit 106. The exhaust gas circuit 104 is connected to the exhaust gas inlet 28 and the exhaust gas outlet 30 of the EGR cooler 10, respectively, and is configured to circulate a portion of the exhaust gas 11 from the internal combustion engine 102 through the channels 12 and back to the internal combustion engine 102. Similarly, the coolant circuit 106 is connected to the coolant inlet 32 and the coolant outlet 34 of the EGR cooler 10, respectively, and is configured to circulate the coolant 13 through the cooling chamber 16 such that heat is transferrable between the exhaust gas 11 and the coolant 13.

The EGR system 100 also may include a cooler 110 in the coolant circuit 106 configured to cool the coolant 13 after it has exited the cooling chamber 16, and therefore has absorbed heat from the exhaust gas 11. This enables the coolant to continue to be circulated through the cooling chamber 16 to exchange heat with the exhaust gas 11. The cooler 110 may be any heat exchanger, including, but not limited to a radiator. In an alternative embodiment, the coolant circuit 106 may be connected to the internal combustion engine 102.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. An exhaust gas recirculation (EGR) cooler for cooling exhaust gas from an internal combustion engine with a coolant, the EGR cooler comprising:

at least one channel having an inlet and an outlet, the exhaust gas being flowable through the at least one channel from the inlet to the outlet; and a casing defining a cooling chamber for carrying the coolant around the at least one channel, the cooling chamber being configured to enable heat transfer between the exhaust gas and the coolant, the casing having:

a coolant inlet and a coolant outlet configured to enable the coolant to enter and exit the cooling chamber; and an exhaust gas inlet from which the exhaust gas enters the at least one channel, and an exhaust gas outlet into which the exhaust gas exits the at least one channel;

wherein at least a portion of the at least one channel is variable between a fully compressed position and an uncompressed position.

2. The EGR cooler of claim 1 wherein the at least one channel is tapered from the inlet to the outlet in at least the fully compressed position.

3. The EGR cooler of claim 1 wherein the at least a portion of the at least one channel comprises at least one slot around it to enable it to be variable between the fully compressed position and the uncompressed position.

4. The EGR cooler of claim 1 further comprising an actuator configured to vary the at least a portion of the at least one channel between the fully compressed position and the uncompressed position.

5. The EGR cooler of claim 4 wherein the actuator is made of a shape memory alloy having a cold state and a hot state.

6. The EGR cooler of claim 5 wherein the actuator is an outer sleeve around the at least a portion of the at least one channel, the outer sleeve being configured to maintain the at least a portion of the at least one channel in the uncompressed position when in the cold state, and to compress the at least a portion of the at least one channel toward the fully compressed position when in the hot state.

7. The EGR cooler of claim 5 wherein the actuator is at least one wire braided around the at least a portion of the at least one channel, the at least one wire being braided at a braid angle.

8. The EGR cooler of claim 7 wherein the at least one wire is configured to maintain the at least a portion of the at least one channel in the uncompressed position when in the cold state, and to compress the at least a portion of the at least one channel toward the fully compressed position when in the hot state when the braid angle is greater than 55 degrees.

9. The EGR cooler of claim 7 wherein the at least one wire is configured to maintain the at least a portion of the at least one channel in the compressed position when in the cold state, and to allow the at least a portion of the at least one channel to expand toward the uncompressed position when in the hot state when the braid angle is less than 55 degrees.

10. The EGR cooler of claim 5 further comprising a current source configured to provide a current through the actuator.

11. An exhaust gas recirculation (EGR) system for cooling exhaust gas from an internal combustion engine with a coolant, the EGR system comprising:

an EGR cooler having:

at least one channel having an inlet and an outlet, the exhaust gas being flowable through the at least one channel from the inlet to the outlet; and a casing defining a cooling chamber for carrying the coolant around the at least one channel, the cooling chamber being configured to enable heat transfer between the exhaust gas and the coolant, the casing having a coolant inlet and a coolant outlet configured to enable the coolant to enter and exit the cooling chamber, and an exhaust gas inlet and an exhaust gas outlet configured to enable the exhaust gas to enter and exit the at least one channel;

an exhaust gas circuit configured to circulate at least a portion of the exhaust gas from the internal combustion engine through the at least one channel of the EGR cooler and back to the internal combustion engine; and a coolant circuit configured to circulate the coolant through the cooling chamber such that heat is transferrable between the exhaust gas and the coolant;

wherein at least a portion of the at least one channel is variable between a fully compressed position and an uncompressed position.

12. The EGR system of claim 11 wherein the at least one channel of the EGR cooler is tapered from the inlet to the outlet in at least the fully compressed position.

13. The EGR system of claim 11 wherein the at least a portion of the at least one channel of the EGR cooler comprises at least one slot around it to enable it to be variable between the fully compressed position and the uncompressed position.

14. The EGR system of claim 11 wherein the EGR cooler further comprises an actuator configured to vary the at least a portion of the at least one channel between the fully compressed position and the uncompressed position.

15. The EGR system of claim 14 wherein the actuator is made of a shape memory alloy having a cold state and a hot state.

16. The EGR system of claim 15 wherein the actuator is an outer sleeve around the at least a portion of the at least one channel, the outer sleeve being configured to maintain the at least a portion of the at least one channel in the uncompressed position when in the cold state, and to compress the at least a portion of the at least one channel toward the fully compressed position when in the hot state.

17. The EGR system of claim 15 wherein the actuator is at least one wire braided around the at least a portion of the at least one channel, the at least one wire being braided at a braid angle.

18. The EGR system of claim 17 wherein the at least one wire is configured to maintain the at least a portion of the at least one channel in the uncompressed position when in the cold state, and to compress the at least a portion of the at least one channel toward the fully compressed position when in the hot state when the braid angle is greater than 55 degrees.

19. The EGR system of claim 17 wherein the at least one wire is configured to maintain the at least a portion of the at least one channel in the compressed position when in the cold state, and to allow the at least a portion of the at least one channel to expand toward the uncompressed position when in the hot state when the braid angle is less than 55 degrees.

20. The EGR system of claim 15 wherein the EGR cooler further comprises a current source configured to provide a current through the actuator.

* * * * *